United States Patent [19]

Miller

[11] 4,198,045

[45] Apr. 15, 1980

[54] SUSPENDED EXERCISING DEVICE

[76] Inventor: G. W. Miller, 1309 Northwest 101, Oklahoma City, Okla. 73114

[21] Appl. No.: 714,969

[22] Filed: Aug. 16, 1976

Related U.S. Application Data

[63] Continuation of Ser. No. 572,114, Apr. 28, 1975, abandoned.

[51] Int. Cl.[2] ..... A63B 21/02

[52] U.S. Cl. ..... 272/142; 272/143; 272/145; 272/117; 272/93; 128/25 R; 128/33

[58] Field of Search ..... 272/126, 134, 144, 145, 272/65, 143; 128/134, 75, 25 R, 33; 5/120–130, 317 R

[56] References Cited

U.S. PATENT DOCUMENTS

| | | | |
|---|---|---|---|
| 753,173 | 2/1904 | Smith | 5/127 X |
| 794,457 | 7/1905 | Gaiter | 128/134 |
| 810,942 | 1/1906 | Hohlfeld | 5/122 |
| 1,456,030 | 5/1923 | Molby | 272/126 |
| 1,456,031 | 5/1923 | Molby | 272/126 |
| 2,569,596 | 10/1951 | Anderegg | 5/122 X |

FOREIGN PATENT DOCUMENTS

| | | | |
|---|---|---|---|
| 487072 | 11/1929 | Fed. Rep. of Germany | 128/134 |
| 525358 | 6/1921 | France | 128/34 |
| 770369 | 6/1934 | France | 5/120 |
| 61555 | 9/1926 | Sweden | 5/122 |
| 1948 | of 1883 | United Kingdom | 273/29BC |
| 9861 | of 1893 | United Kingdom | 273/29 BC |

*Primary Examiner*—William R. Browne
*Attorney, Agent, or Firm*—Hubbard, Thurman, Turner, Tucker & Glaser

[57] ABSTRACT

An exercising device is disclosed. The exercising device comprises an elongated body support member that will accommodate a person using the device in a prone, or sitting position. Rigid elongated end members extend along and are affixed to the end edges of the body supporting member. Rigid elongated stabilizer members are attached to the elongated end members with a flexible attachment device. The apparatus is suspended from a fixed anchor device, such as a wall, ceiling, or a stable frame, by flexible suspension device that are strung between the stabilizers and the anchor points. Elastic device are disposed in at least one of the suspension device whereby the suspension device can be elongated when a force is applied to the suspension device. The elastic device disposed in the suspension device thus allows the user to cause the body supporting member to move upwardly, downwardly and/or horizontally in response to certain forces that are applied to the apparatus. The forces can be supplied to the apparatus by means of muscular exertion of the user or by some external device such as a motor arrangement. The vertical and/or horizontal movement of the body supporting member with the user supported on such body supporting member as well as the muscular exertion of the user in applying pushing or pulling forces to the apparatus causing the elastic device to elongate and contract, allows the user to accomplish the desired exercise.

16 Claims, 5 Drawing Figures

SUSPENDED EXERCISING DEVICE

This is a continuation of application Ser. No. 572,114, filed Apr. 28, 1975, now abandoned.

BACKGROUND OF THE INVENTION

This invention relates to an exercising apparatus. In another aspect, this invention relates to an exercising device that is suspended between fixed anchor points. In another aspect, this invention relates to an exercising apparatus having an elongated body supporting member to support the user in a prone or sitting position while using the apparatus for exercising. In still another aspect, this invention relates to an exercising apparatus that can be utilized for a wide variety of exercises including exercises required by users having certain muscular, nervous and skeletal disorders.

Exercise is essential for maintaining good physical health. It is well-known that without proper exercise, muscle tissues tend to deteriorate and will cease to function. Therefore, it is an established principle of preventive medicine that a sound exercise program, whereby essentially all muscles of the body can be exercised, is necessary for maintaining good health.

Since many professions and occupations are sedentary professions and occupations, it is extremely difficult for many people to maintain an adequate and proper exercise program. Additionally, many people are afflicted with muscular or nervous disorders that make it impossible for them to maintain an adequate and proper exercise program because of their physical handicaps.

It is therefore desirable to have an inexpensive apparatus that can be conveniently utilized for a complete exercise program by all types of users including those having severe physical handicaps.

SUMMARY OF THE INVENTION

Accordingly, it is an object of this invention to provide an improved exercising apparatus. It is another object of this invention to provide a new and improved exercising apparatus that can be utilized for a complete exercise program by all types of individuals, including those having severe physical handicaps. It is still a further object of this invention to provide a new and improved exercising apparatus that is inexpensive and easy to use in the home, in physical therapy facilities, in gymnasiums and the like.

Other aspects, objects and advantages of this invention will be apparent to those skilled in the art from the following disclosure and appended claims.

The exercising apparatus of this invention comprises an elongated body supporting member that functions to support the user as the user carries out a predetermined exercise program. The elongated body supporting member is mounted in a generally horizontal plane, it being understood that parts of the body supporting member will be displaced from the horizontal plane during use of the apparatus. The elongated body supporting member has rigid elongated end member portions that extend along and are affixed to the end edges of the body supporting member. Rigid elongated stabilizer members are attached to the elongated end members with flexible attachment means. The rigid elongated stabilizer members are substantially parallel to the rigid elongated end members and are located at a predetermined distance from the end members. The distance of course is determined by the length of the flexible attachment means. Flexible suspension means are attached to the stabilizer means and suspend the entire exercising apparatus from fixed anchor means. The fixed anchor means can be affixed to the walls or ceiling of a room, from fixed post means or from stable frame means. Elastic members are disposed within at least one of the sets of flexible suspension means, whereby the suspension means can alternately elongate and contract to provide a vertical and/or horizontal movement of the body supporting member. Forces exerted on the apparatus to cause the alternate elongation and contraction of the suspension means, thereby causing the vertical and/or horizontal movement of the body supporting member, can be supplied by muscular exertion by the user on the apparatus or can be supplied from an external source, such as a motor mechanism that is operably coupled to the apparatus. The vertical and horizontal movement of the body supporting member will thus result in a movement of the various portions of the anatomy of the user as he is supported by the body supporting member.

DESCRIPTION OF DRAWINGS

Some of the preferred embodiments and features of the exercising apparatus of this invention are illustrated in the accompanying drawings wherein.

DESCRIPTION OF PREFERRED EMBODIMENTS

Figure 1:
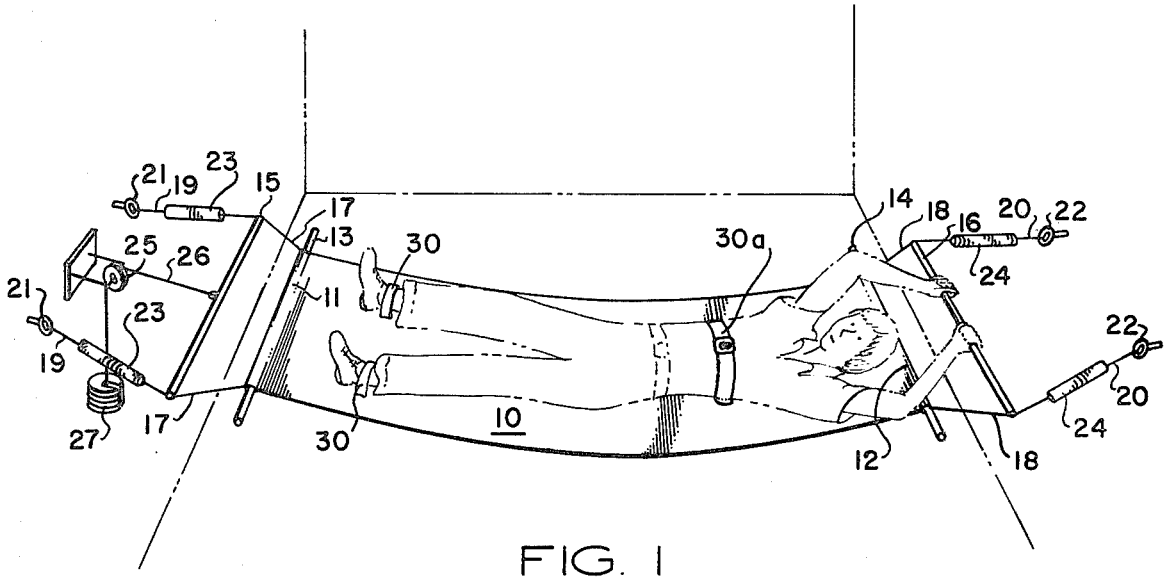
FIG. 1 is a perspective view of a wall mounted exercising device with the user exercising in a supine position.

The preferred embodiments of this invention can be most conveniently described by referring to the drawings. The drawings illustrate several of the preferred embodiments of the invention. In the following description, the elements common to each of the exercise devices in the various drawings will be referred to by common numerical designation.

Each of the exercising devices of this invention illustrated in the drawings includes an elongated body supporting member 10. Elongated body supporting member 10 has two end edges 11 and 12. Rigid elongated end members 13 and 14 extend along and are affixed to end edges 11 and 12 respectively. End edges 11 and 12 are attached to rigid elongated end members 13 and 14 at least at points adjacent the outer edges of each end edge. Preferably, end edges 11 and 12 will be attached to rigid elongated end members 13 and 14 along substantially the entire length of each of the end edges. Preferably, rigid elongated end members 13 and 14 are parallel to each other. Rigid elongated end members 13 and 14 should be at least as long as the length of end edges 11 and 12 respectively. In the preferred embodiments of this invention, the elongated end members will be substantially perpendicular to the long axis of the elongated body supporting member.

Rigid elongated stabilizer members 15 and 16 are positioned at locations slightly removed from rigid elongated end members 13 and 14 respectively. Flexible attachment means 17 and 18 are attached to the adjacent rigid elongated end members and rigid elongated stabilizer members. Thus, flexible attachment means 17 connect rigid elongated stabilizer member 15 with rigid elongated end member 13 and flexible stabilizer means 18 connect rigid elongated stabilizer member 16 with rigid elongated end member 14. Flexible attachment means 17 and 18 are affixed to elongated end members 13 and 14 at least at points near the outer edges of end edges 11 and 12. If desired, more than two flexible attachment means can be utilized for connecting the respective end members with the elongated stabilizer members. Preferably, the rigid stabilizer members will be substantially parallel to the adjacent rigid end members on each end of the device.

Flexible suspension means are utilized to attach to the stabilizer members and suspend the apparatus from a fixed anchor means. As shown in FIGS. 1, 2, 4 and 5, one end of each of flexible suspension means 19 and 20 is attached to rigid elongated stabilizer members 15 and 16 respectively. The other end of each of flexible suspension means 19 and 20 is adapted to be attached to fixed anchor means 21 and 22 respectively. The flexible suspension means illustrated in FIG. 3 differs from the flexible suspension means illustrated in the other figures in that only one fixed anchor means is used to suspend the apparatus at each end thereof. As illustrated in FIG. 3, the flexible suspension means that is affixed to rigid elongated stabilizer member 15 is made up of three separate members 19*a* that are affixed to separate points along rigid elongated stabilizer member 15 and converge at a common point. One end of flexible member 19*b* is attached to said common point and the other end thereafter is adapted to be affixed to fixed anchor means 21. Likewise, flexible members 20*a* are attached to rigid elongated stabilizer member 16 at three different points and converge at a common point where they are affixed to one end of flexible member 20*b*. The other end of flexible member 20*b* is adapted to be affixed to fixed anchor means 22.

Elastic means 23 and 24 are disposed in and a part of flexible suspension means 19 and 20 respectively. It is important that the suspension means on at least one end of the exercising device of this invention have the elastic means disposed therein. It is preferred, however, that the suspension means on only one end of the exercising apparatus have elastic means disposed therein.

The foregoing components are common to all of the exercising devices of this invention. However, various additional components may be present to increase the capabilities of the exercising device and to increase the adaptability of the device to the needs of the individual user. As shown in FIG. 1, an additional tensioning device is affixed to stabilizer member 15 to increase the lateral tension of the body supporting member so as to allow it to support heavier loads as will be experienced with heavy or obese users and to add to workload of the user. Pulley 25 is attached to a fixed anchor means and a suitable flexible connector such as rope 26 is attached to the midsection of elongated stabilizer member 15, passed over pulley 25 and connected with adjustable weight member 27. By adjusting the load on weight member 27, more or less lateral tension can be applied to the apparatus to allow it to support heavier users or to increase work loading capacity of the exercising device. This adjustable lateral tension feature is quite beneficial when sophisticated exercise programs are carried out wherein the user will exert different types of forces on the apparatus with different portions of his anatomy. For example, in the arm exercise routine discussed hereinafter, it may be desirable to have greater lateral tension applied to the body supporting member than when a leg exercise program is carried out. In such instances, it would be desirable to increase the amount of load on adjustable weight member 27 when the arm exercise routine is carried out.

It will be appreciated that increasing the tension on elastic means 23 and/or 24 will accomplish the same result as adding weight to adjustable weight member 27. In some instances it may be desirable to utilize readily changeable elastic means 23 and/or 24 to have the capability of adjusting the lateral tension exerted on the body supporting member. It may also be desirable to equip the apparatus with hooks or other devices to allow additional elastic means 23 and/or 24 to be used during certain exercise programs.

Figure 2:
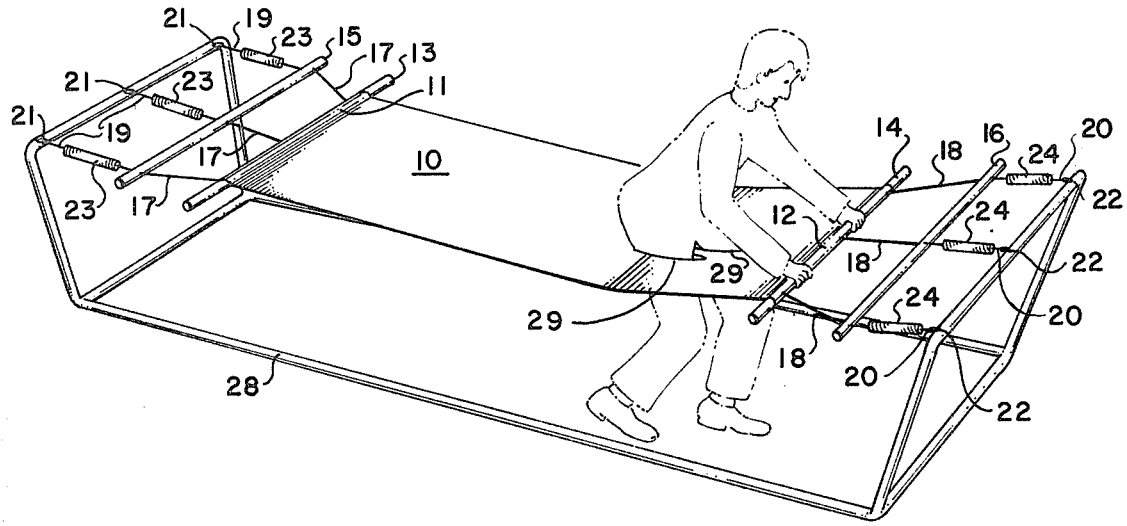
FIG. 2 is a perspective view of a stand mounted exercising device with the user exercising in a sitting or crouching position.
Figure 3:
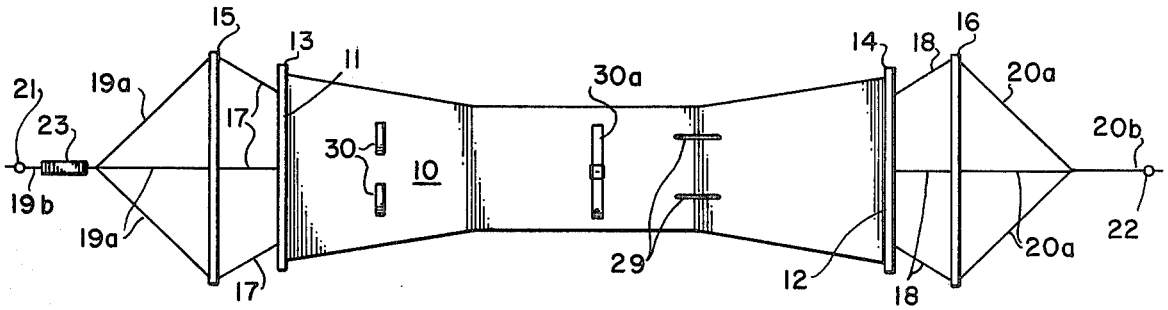
FIG. 3 is a top view of another preferred embodiment of this invention showing another preferred suspension system and configuration of the body supporting member.

As shown in FIG. 2, portable frame mechanism 28 is utilized to provide the necessary fixed anchor means whereby the apparatus can be suspended for use. Portable frame 28 can be fabricated from materials such as tubular steel and the like. The use of portable frame 28 allows the exercising device to be moved from one location to another and will allow the apparatus to be disassembled and folded away for easy storage when it is not in use.

As illustrated in FIG. 3, elongated body supporting member 10 can have additional components to allow for a more comprehensive exercise program. For example, leg apertures 29 can be disposed in elongated body supporting member to receive the legs of the user whereby the exercise program can be carried out while the user is in a sitting or crouching position, such as illustrated in FIG. 2. In such instances, leg apertures 29 will be disposed at a point intermediate the end edges of body supporting member 10. Additionally, ankle restraining or heel restraining means 30 and/or body restraining means 30*a* may also be incorporated into the structure of elongated body supporting member 10. Such ankle restraining or heel restraining means can include apertures whereby the user may insert his feet while carrying out a leg exercise program or they may include loops attached to the surface of elongated body supporting member 10 to allow the user to slip his feet, heels or ankles through such apertures or loops. Such ankle restraining or heel restraining devices are useful for exercises resembling "sit-ups" or for exercise where the user has no control over his legs and as a result the users' legs tend to leave the surface of the body supporting means during the exercise. Body restraining means 30*a* can serve to prevent severely disabled users from sliding laterally off the exercising device during use. Body restraining means 30*a* can be equipped with a suitable buckle, snap or other means to facilitate use in securing the user to body supporting member 10.

Figure 4:
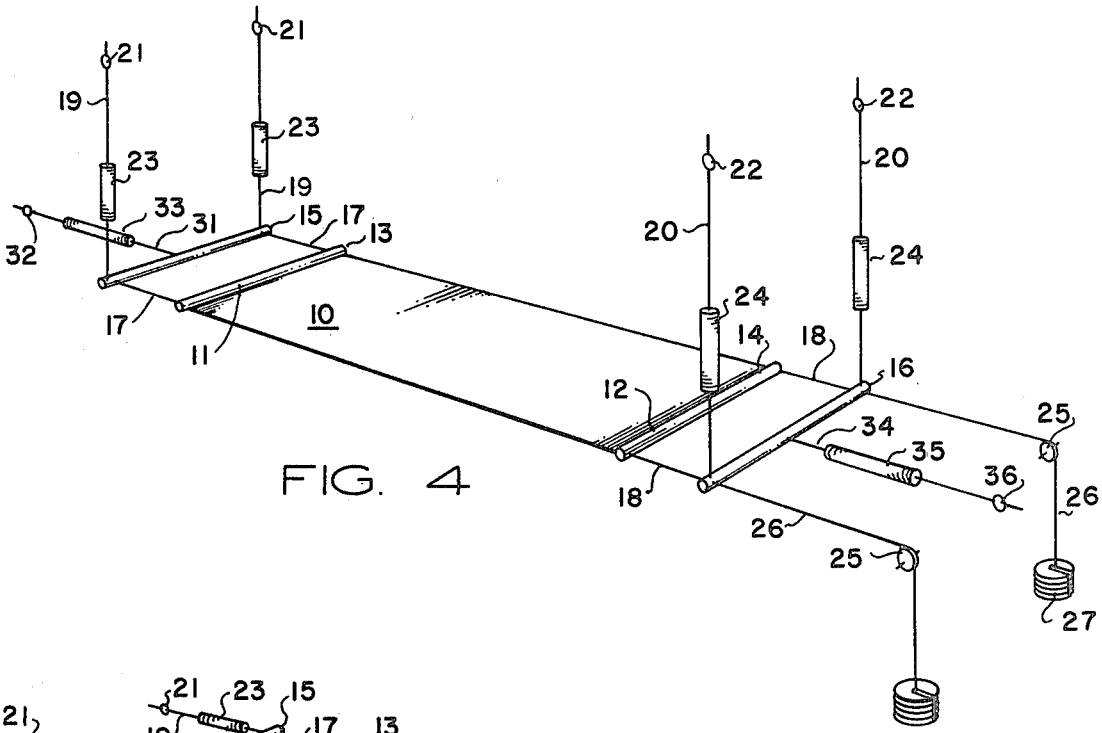
FIG. 4 is a perspective view of a ceiling mounted exercising device.

The apparatus illustrated in FIG. 4 is a ceiling or overhead frame suspended apparatus wherein flexible suspension means 19 and 20 are suspended from suitable fixed anchor means in the ceiling of a building or from an overhead frame. When the apparatus is suspended from an overhead frame or a ceiling, and when the elongated body supporting member is a relatively flexible member, it will be desirable to incorporate devices to exert lateral tension on the body supporting member to maintain the body supporting member in a generally horizontal plane. As illustrated in FIG. 4, one end of tensioning means 31 can be attached to elongated stabilizer member 15 and the other end can be adapted to connect to a suitable fixed anchor 32 in a wall or frame. Tensioning means 31 should have a suitable elastic member disposed therein such as coil spring 33. A similar tensioning means 34 with coil spring 35 and an end adapted to connect to fixed anchor means 36 can also be attached to rigid elongated stabilizer member 16 at the other end of the device. If desired, adjustable weight members 27 may be attached to the apparatus in FIG. 4 by means of ropes 26 and pulleys 25 as discussed above with respect to FIG. 1.

Figure 5:
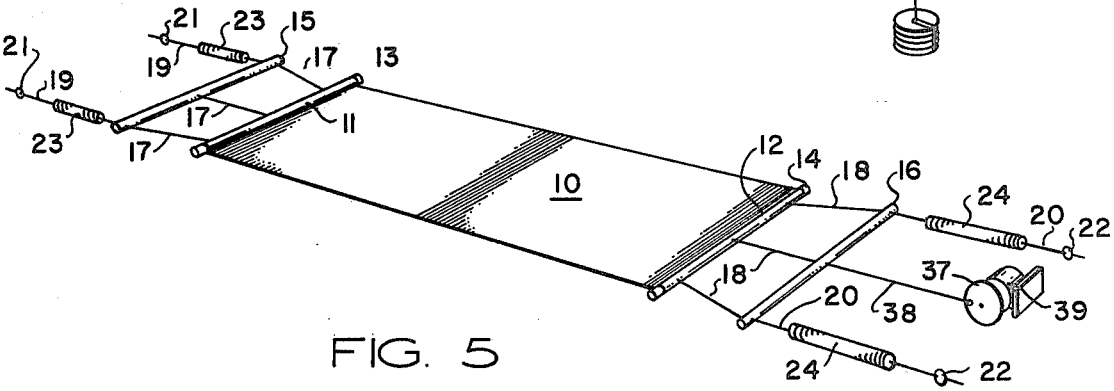
FIG. 5 is a perspective view of another embodiment of the invention wherein one end of the exercising device is attached to an electric motor driven eccentric crank.

An additional feature of this invention is illustrated in FIG. 5 wherein stabilizer means 16 is attached to an eccentric crank 37 through coupling means 28. Eccentric crank 37 can be driven by means of motor 39 which can be attached to a fixed surface such as a wall or a frame. By utilizing the eccentric crank and coupling mechanism shown in FIG. 5, it is possible to provide a desired movement to the exercising device whereby users having severe muscular and nervous disorders can undergo therapeutic exercise programs. Thus, even though a user may be so severely handicapped that he is unable to supply the necessary muscular forces to activate the apparatus, the motor driven eccentric crank can supply such force and the handicapped user can still obtain at least some of the benefits of the apparatus wherein the moving body supporting member 10 will cause certain portions of the user's anatomy to undergo movement, thus supplying a degree of exercise and therapy.

The elongated body supporting member 10, illustrated in all of the figures, should be of sufficient size to accommodate the user. Therefore, for an adult user, it is preferable that the length of the body supporting member be at least about 6 feet. The width of the body supporting member should be at least about 24 inches. One of the preferred configurations of the body supporting member is a rectangle having straight end edges that are affixed to the rigid elongated end members. However, as shown in FIG. 3, the body supporting member can have a configuration wherein the side edges are more narrow at the midsection than they are at the end edges. The end edges need not be the same length. The material of construction of the elongated body supporting member is preferably a flexible material such as heavy fabric, heavy plastic, close mesh net and the like. It has been found that flexible material such as heavy fabric, net or reinforced plastic material have an advantage over more rigid materials in that a harmonic motion can be established during use of the apparatus whereby the center portion of the apparatus will move in a vertical direction over a greater distance than the vertical movement of the apparatus near the end edges of the body supporting member. This beneficial effect thus provides for a desirable exercising of the muscles in the abdomen and back and for movement of skeletal joint anatomy of the user when the user is in a prone position on the body supporting member. However, in some instances, especially where the apparatus is being used primarily for leg or arm exercise, the body supporting member may be fabricated from a more rigid material such as sheet plywood and the like.

The elongated end members that extend across the end edges of body supporting member 10 must be sufficiently rigid to hold the end edges of the body supporting member in a substantially straight configuration. Therefore, when the body supporting member is fabricated from a flexible material such as fabric, net, or plastic sheet, the elongated end members should be relatively rigid rod-like or bar-like structures. Of course, when the body supporting member is fabricated from a rigid material such as plywood, the end edges of the plywood itself will serve as the rigid elongated end members.

To ensure the proper stability of the exercising device of this invention, at least the outer edges of the end edges of the body supporting member should be attached to the rigid elongated end members. The end members are preferably at least substantially as long as the end edge that they are attached to. Preferably, the end edges of the body supporting member will be attached or affixed to the rigid elongated end members along substantially the entire length of the end edges thereof. One convenient method for affixing the rigid elongated end members to the end edges of the elongated body supporting member, when the body supporting member is fabricated from a fabric, flexible plastic, or net material is to form a tubular seam along the length of the end edges and thereafter insert the elongated end members into the tubular seam. Preferably, the rigid elongated end members will be substantially parallel to each other. Rigid elongated end members may be fabricated from any available material such as tubular metal, wooden rods or dowels and the like.

Rigid elongated stabilizer members must be attached to the apparatus at a point removed from the flexible end members. The function of the rigid elongated stabilizer members is to provide stability to the apparatus as it is utilized to carry out the desired exercise program. This effectively prevents the elongated body supporting member from tipping over thus causing the user to fall from the supporting member. It has been found that rigid elongated stabilizer members should be at least about 6 inches from rigid elongated end members extending along the end edges of the body supporting member. Preferably, rigid elongated stabilizer members will be substantially parallel to the adjacent elongated end member. As in the case of rigid elongated end members, the rigid elongated stabilizer members are preferably fabricated from a material that is sufficiently rigid that they will maintain a substantially straight configuration during use. Therefore, rigid elongated stabilizer members can be fabricated from any suitable material such as tubular metal, wooden rods, wooden dowels and the like. Preferably, elongated stabilizer members will be substantially at least about as long as the length of the adjacent end edge of the body supporting member. When the length of the stabilizer member is increased, it has been found that the exercising device tends to be more stable during use.

The elongated end members are attached to the elongated stabilizer members by means of flexible attachment means. The flexible attachment means can be any suitable flexible material such as rope, fabric webbing, cord, chains and the like. One end of each of the flexible attachment means should be attached to the elongated end members at points at least near the outer edges of the end edges of the body supporting member. Therefore, at least two flexible attachment means will be used for attaching the end members to the stabilizer members. Of course, additional flexible attachment means may be utilized. In some instances, the flexible attachment means may be one continuous piece of fabric or other flexible material that is attached to the stabilizer member and the end member or substantially the entire lengths thereof. The other end of the flexible attachment means will be affixed to the stabilizer means. Preferably, the flexible attachment means will be attached to the stabilizer members at points that are at least substantially as far apart as the length of the adjacent end edge of the body supporting member. By attaching the flexible attachment means to the stabilizer means in this manner, the stability of the body supporting member is increased during use.

The flexible suspension means can be formed from any flexible material that has sufficient strength to suspend the apparatus during use. Therefore, materials such as rope, heavy cord, fabric webs, chains and the like may be utilized as the suspension means. To ensure the proper stability of the apparatus during use, there should be at least two flexible suspension means attached to each of the rigid elongated stabilizer members. Preferably, one end of each of the flexible suspension means will be attached to the elongated stabilizer members at points that are substantially the same distance apart as the length of the adjacent end edge of the body supporting member. The other end of the flexible suspension means should be adapted to be affixed to a suitable fixed anchor means. Suitable rings, hooks and the like can be utilized for attaching the suspension means to the fixed anchor means. As discussed above, the anchor means can be single or multiple anchor points. As illustrated in FIGS. 1, 2, 4 and 5, multiple anchor points can be utilized to suspend the apparatus from. However, as shown in FIG. 3, a single anchor point at each end of the apparatus can be utilized to suspend the apparatus from.

It is important that the suspension means on at least one end of the apparatus contains a suitable elastic means whereby the effective length of the suspension means can be alternately elongated and contracted during use. Therefore, the material for forming the suspension means on at least one end of the apparatus may be an elastic material such as heavy rubber and the like that is capable of being elongated and returning to substantially its initial length during operation of the device. Preferably, however, springs can be incorporated into the suspension means on at least one end of the apparatus to provide the necessary elasticity of the suspension means. Conventional coil springs have been found to be quite effective as the elastic means that are incorporated into the suspension means of the exercising device of this invention. Of course, the spring or elastic means should be of sufficient strength to support the user during operation of the device and furnish adequate resistance to input forces by the user to allow accomplishment of meaningful exercise. While the elastic means must be present in the suspension means on both ends of the exercising devices of this invention, it is preferred that the spring or elastic means be present in the suspension means on only one end of the device.

Of course, the anchor means for suspending the apparatus can be from any substantially fixed structure such as a wall, a ceiling, a post arrangement or a frame apparatus. It will, of course, be understood that a considerable amount of force is exerted on the anchor means during use and that they should be sufficiently strong to support the user as the exercise is carried out.

When an exercise program is carried out using the apparatus of this invention with the user in a prone position, it is preferable that the body supporting member be maintained in a substantially horizontal configuration. Therefore, the anchor means should be positioned such that the suspension means exerts a lateral tension on the body supporting member as illustrated in FIGS. 1, 2, 3 and 5. When the apparatus is ceiling mounted as shown in FIG. 4, it will be necessary that tensioning means be provided for maintaining the body supporting member in a substantially horizontal configuration. Therefore, additional tensioning means such as coil springs attached to fixed anchor means as well as a rope and pulley arrangement with a weight means, may be utilized to supply the desired tension to maintain the body supporting member in a substantially horizontal configuration.

An almost unlimited number of different types of exercise can be performed using the exercising apparatus of this invention. However, only a few of the exercises will be discussed herein to illustrate how the apparatus may be used. In FIG. 1, the user is in a supine position with his arms extended over his head to grasp a stabilizer member. By alternately pulling and releasing the stabilizer member, the user will cause the elastic means in the suspension means to elongate and contract. Thus, the effective length of the suspension means will be changed and the body supporting member will tend to move downwardly and/or horizontally as the effective length of the suspension means is increased. As the length of the suspension means decreases upon contraction of the elastic means, the body supporting member will move upwardly. By an alternating pulling and releasing of the stabilizer member, a rhythmic upward, downward and/or horizontal movement of the body suspension member is established. The user can continue this type of physical exertion with his arms for a desired period of time. Such an exercise is extremely beneficial to the upper arms, shoulders and abdomen. As shown in FIG. 1, the exercising device can also be utilized with the user slipping his ankles or heels through restraining loops 30 and pulling inwardly or pushing outwardly with his legs to set up the alternating elongation and contraction of the elastic means and the suspension means. Such an exercise is quite beneficial to the muscles in the legs and abdomen. Similar exercises may also be performed by the user in a face down prone position on the elongated body supporting member.

In addition to the numerous exercises that can be carried out with the user in a prone position on the body supporting member of the apparatus of this invention, other exercises can be utilized with the user in a sitting or crouching position. For example, the user can straddle the flexible body supporting member with his legs extending over each side of the flexible body supporting member or, as illustrated in FIG. 2, the user can insert his feet and legs through the leg apertures, if the body supporting member is so equipped with such apertures, and allow his feet to rest on the floor or other surface beneath the device. Thereafter, the user can grasp either the rigid elongated end member or the rigid elongated stabilizer member and alternately exert force downwardly on the floor or surface beneath the apparatus and relax. This will cause the body supporting member to move upwardly and downwardly as the elastic means in the suspension means elongates and contracts. This particular type of exercise is particularly useful for individuals who have some degree of muscular or nervous system problems in the legs. This allows such a handicapped user to exercise the muscles in his legs even though the muscles are not sufficiently strong to support the user without the aid of the exercising device of this invention.

In addition to the foregoing exercises, a vast number of other exercises can be performed using the exercise device of this invention. One particularly advantageous result that can be obtained from the exercising device of this invention is in the relief of nervous tension. When the exercising device is properly utilized, a harmonic type motion is set up wherein the body supporting member moves upwardly and downwardly in a harmonic motion. When the user rests on the body supporting member while it is undergoing such a harmonic motion, a considerable amount of relaxation of the central nervous system is observed. Therefore, it is quite beneficial to utilize the apparatus of this invention as a device to aid in the relief of tension. Thus, even when the user is totally incapable of exerting muscular force on the apparatus to cause the harmonic motion, a motor driven device such as that illustrated in FIG. 5 can be utilized to initiate and maintain the desired harmonic motion of the body supporting member.

It should be understood that the foregoing disclosure represents some of the preferred embodiments of this invention. It will be apparent that various changes and modifications may be made in the illustrated embodiments without departing from the spirit and scope of this invention.

I claim:

1. An exercising apparatus comprising:

(a) an elongated body supporting member having a first end edge and a second end edge;

(b) a first rigid elongated end member extending along and affixed to said first end edge of said body supporting member;

(c) a second rigid elongated end member extending along and affixed to said second end edge of said body supporting member;

(d) a first rigid elongated stabilizer member;

(e) a second rigid elongated stabilizer member;

(f) a first flexible attachment means for attaching said first end member to said first stabilizer member;

(g) a second flexible attachment means for attaching said second end member to said second stabilizer member;

(h) a first flexible suspension means for attaching to said first stabilizer member and adapted to attach to a first substantially fixed anchor means thereby suspending one end of said apparatus from said anchor means;

(i) a second flexible suspension means for attaching to said second stabilizer member and adapted to attach to a second substantially fixed anchor means thereby suspending one end of said apparatus from said anchor means; and (j) elastic means disposed in at least one of said first suspension means and said second suspension means whereby said suspension means can be elongated and contracted.

2. The apparatus of claim 1 wherein said elongated body supporting member is a flexible member.

3. The apparatus of claim 2 wherein said first end member and said second end member extend along substantially the entire length of said first end edge of said body supporting member and said second end edge of said body supporting member respectivley and said body supporting member is affixed to said first end member at least at points adjacent the outer edges of said first end edge and said body supporting member is affixed to said second end member at least at points adjacent the outer edges of said second end edge and said first end member and said second end member are substantially parallel.

4. The apparatus of claim 3 wherein said first end member is affixed to said first end edge of said body supporting member along substantially the entire length of said first end edge and said second end member is affixed to said second end edge of said body supporting member along substantially the entire length of said second end edge.

5. The apparatus of claim 3 wherein said first flexible attachment means and said second flexible attachment means each comprise at least two elongated flexible members.

6. The apparatus of claim 3 wherein said first stabilizer member and said second stabilizer member are at least substantially as long as said first end edge and said second end edge of said body supporting member respectively and said first stabilizer member and said second stabilizer are substantially parallel to said first end member and said second end member.

7. The apparatus of claim 6 wherein said first flexible attachment means comprises at least two elongated flexible members which are attached to said first stabilizer members at points that are substantially the same distance apart as the length of said first end edge of said body supporting means and said second flexible attachment means comprises at least two elongated flexible members which are attached to said second stabilizer members at points that are substantially the same distance apart as the length of said second end edge of said body supporting means.

8. The apparatus of claim 3 wherein said first flexible suspension means and said second flexible suspension means each comprise at least two elongated flexible members.

9. The apparatus of claim 8 wherein said elongated flexible members are attached to said first stabilizer means and said second stabilizer means at points that are substantially the same distance apart as the length of said first end edge and said second end edge of said body supporting means respectively.

10. The apparatus of claim 9 wherein said elastic means are spring means disposed in the elongated flexible members comprising said first flexible suspension means.

11. The apparatus of claim 9 wherein said elastic means are spring means disposed in the elongated flexible members comprising said first flexible suspension means and said second flexible suspension means.

12. The apparatus of claim 11 wherein ankle restraining means adapted to restrain the ankles of a user are disposed in said body supporting member intermediate said first end edge and said second end edge thereof.

13. The apparatus of claim 2 wherein said body supporting means is made of fabric.

14. The apparatus of claim 13 wherein apertures adapted to receive the legs of a user are disposed in said body supporting member intermediate said first end edge and said second end edge thereof.

15. The apparatus of claim 1 wherein said body supporting means is substantially rectangular in shape.

16. The apparatus of claim 1 wherein said body supporting means has side edges that are more narrow at the midsection than at the end edges.

* * * * *